United States Patent [19]

Sharlow

[11] 4,218,945

[45] Aug. 26, 1980

[54] APPARATUS FOR GANGING AND CUTTING A PLURALITY OF LAYERS OF STRIP MATERIAL

[75] Inventor: Roger C. Sharlow, Plano, Tex.

[73] Assignee: Liquid Paper Corporation, Dallas, Tex.

[21] Appl. No.: 906,441

[22] Filed: May 17, 1978

[51] Int. Cl.[2] ..... B26D 7/06

[52] U.S. Cl. ..... 83/436; 83/272; 226/108; 226/109; 83/420; 83/444

[58] Field of Search ..... 83/436, 272, 444, 420, 83/241, 261, 263, 449; 226/195, 108, 109, 189

[56] References Cited

U.S. PATENT DOCUMENTS

| | | | |
|---|---|---|---|
| 3,066,562 | 12/1962 | Barnett et al. | 83/436 X |
| 3,325,071 | 6/1967 | Schmitz | 226/108 |
| 3,386,679 | 6/1968 | Foulon et al. | 226/109 |
| 3,558,254 | 1/1971 | Cahill | 83/436 X |
| 3,688,622 | 9/1972 | Wahnschaff | 83/436 X |
| 3,776,081 | 12/1973 | Becker | 83/272 |

*Primary Examiner*—Donald R. Schran
*Attorney, Agent, or Firm*—Richards, Harris & Medlock

[57] ABSTRACT

An apparatus for ganging and cutting a plurality of layers of strip material in predetermined lengths includes a frame supporting a drive and driven roller acting together to draw the layers of material to a cutter where the layers of material are severed. The drive roller, acting with the driven roller, draws a plurality of layers of material from a rack structure where each layer is individually wound on a rotatable roll. Each layer of strip material is drawn from a roll and a plurality of layers are ganged over a cylindrical roller. The ganged layers of material are directed over a convex-concave roller combination to maintain alignment. The layers of material are then drawn over an upper support roller and are guided to the drive roller through a guide plate structure. The guide plate structure includes a back plate having a slot therein and a top plate having a longitudinal shoulder corresponding to the slot. The layers of material are maintained within the slot of the back plate to prevent lateral movement by the layers of material. The layers of material are engaged between the drive and driven rollers and directed to a severing station where the layers of strip material are cut into predetermined lengths. Structure for tensioning each layer of strip material is provided.

32 Claims, 13 Drawing Figures

APPARATUS FOR GANGING AND CUTTING A PLURALITY OF LAYERS OF STRIP MATERIAL

BACKGROUND OF THE INVENTION

1. Field of the Invention

The present invention relates to an apparatus for ganging and cutting a plurality of layers of strip material in predetermined lengths.

2. Prior Art

Many products are packaged and sold in multiple layers or sheets. For example, typewriter ribbon correcting tape is often sold in packages having several tabs of tape stacked in multiple layers. While there are apparatus for drawing strip material from a continuous roll, severing the single layer of material and packaging the strip, the ganging of a plurality of layers of strip material for severing and packaging as the material is unwound from a plurality of rolls has not been possible on a high speed, continuous basis. The systems used for severing and packaging single layers of material have not been usable for multiple layers of material because of the inability of these apparatus to prevent binding and out of alignment problems encountered when multiple layers are operated on simultaneously.

In working with multiple layers of material, prior art units have generally resorted to apparatus which engage the leading edges of multiple layers of material, and then pull the layers of material from their respective rolls. After a desired amount of material has been drawn from the rolls, the layers are then severed and carried away by a conveyer or other structure. The clamping device then reengages the forward ends of a plurality of layers and the process is repeated. Such a system is disclosed in U.S. Pat. No. 3,701,299 to Gunther Stumpf, issued Oct. 31, 1972. Although this type of system may be acceptable in some applications, it is not adaptable to a high speed operation involving numerous layers of ganged material.

SUMMARY OF THE INVENTION

The present invention provides an apparatus for continuously ganging and cutting a plurality of layers of strip material in predetermined lengths. The apparatus includes a frame supporting a guide plate structure for receiving a plurality of layers of strip material therethrough. A drive roller cooperates with a driven roller to engage the layers of material between the two rollers to draw the layers of material through the guide plate structure and past the rollers. As the layers of material are driven past the rollers, they are severed in predetermined lengths for packaging.

In accordance with one embodiment of the invention, the strip material is stored on rolls mounted on a rack. The number of strips of material to be ganged to form a plurality of layers is drawn from the rolls and ganged in a layered relationship over a roller guide. The roller guide includes a shaft having a cylindrical roller positioned on the shaft with a pair of side collars attached to the shaft on opposite sides of the roller. The layers of strip material pass over the roller between the collars. The layers of strip material are then directed over a second guide structure including a convex roller spaced from a concave roller with the rollers in contact with opposite faces of the layered materials. the layers of material are then directed past an upper roller including a cylindrical drum and into the guide plate structure.

In accordance with one embodiment of the invention, the guide plate structure includes a back plate having a longitudinal slot formed therein corresponding to the width of the layers of strip material and deeper than the thickness of the layers of material. The guide plate structure includes a top plate having a longitudinal shoulder corresponding to the slot in the back plate with the shoulder being shorter in height than the depth of the slot. The top plate is attached to the back plate with the shoulder engaging the slot such that the layers of strip material are guided between the back plate and the top plate within the slot of the back plate.

The layers of material are engaged between the drive roller and the driven roller to be drawn therebetween. In accordance with one embodiment of the invention, the drive roller includes a drum having an annular receiving slot substantially corresponding in width to the width of the layers of strip material for receiving the layers of material therein. The driven roller has an annular shoulder extending therefrom slightly narrower in width than the receiving slot in the drive roller and slightly higher than the depth of the receiving slot. The outer surface of the annular shoulder engages the bottom of the receiving slot of the drive roller to pinch the layers of strip material therebetween and draw the material through the drive and driven rollers.

As the layers of material are directed beyond the the drive and driven rollers, the layers are severed into predetermined lengths for subsequent packaging. After being severed, the plurality of layers are engaged between corresponding rotating belts which direct the severed layers of material to a packaging station.

In accordance with one embodiment of the invention, prior to severing, the layers of material are pinched between opposing bar elements positioned below the cutting structure. These bar elements are engaged against the layers of strip material prior to severing the material to facilitate cutting.

In accordance with another embodiment of the invention, a plurality of finger guides are supported on opposite sides of the layers of strip material adjacent the drive and driven rollers to prevent the strip material from adhering to the rollers as the material passes therebetween.

A tension device is provided to control the tension on each strip of material. The devices are attached to the rack structure on which the material rolls are mounted. Each tension device includes a U-shaped frame having a base leg with two side legs extending therefrom. A shaft extends through the side legs of the tension device frame and is attached to the rack. A cylinder is mounted on the shaft intermediate of the side legs of the tension device frame for receiving the strip material therearound.

A padded bar is mounted for slidable engagement between the side legs. A screw operates between the base leg of the U-shaped frame and the movable bar for selectively engaging the strip material between the bar and the cylinder to restrict movement of the strip material past the cylinder. By controlling the pressure against the strip material through engagement or disengagement of the screw, the tension on the strip material may be controlled as the drive roller draws the layers of strip material toward the severing device.

Any number of layers of strip material may be ganged and drawn into the present unit for severing into predetermined lengths. The arrangement of the first and second guide rollers, as well as the guide plate structure and drive and driven rollers, provides an arrangement whereby multiple layers of material may be drawn continuously through the present apparatus without binding or moving out of alignment.

In accordance with still another embodiment of the invention, multiple rows of layered strip material are simultaneously drawn from a rack structure supporting a plurality of continuous rolls of strip material. In this embodiment, a guide plate structure has a back plate with a plurality of parallel slots therein for cooperating with a top plate having corresponding shoulders for engagement in these slots. Layers of strip material are guided between the back plate and the top plate within the slots in the back plate. A drive roller is constructed with a plurality of annular slots therein for receiving the rows of layered material with a driven roller having annular shoulders corresponding with the slots in the drive roller such that the layers of material are engaged therebetween to be drawn therethrough. Each row of layered material is then directed to a cutter device for severing into predetermined lengths for later packaging.

DETAILED DESCRIPTION OF THE DRAWINGS

For a more complete understanding of the present invention and for further details thereof, reference is now made to the following description taken in conjunction with the accompanying drawings in which.

DESCRIPTION OF THE PREFERRED EMBODIMENTS

Figure 1:
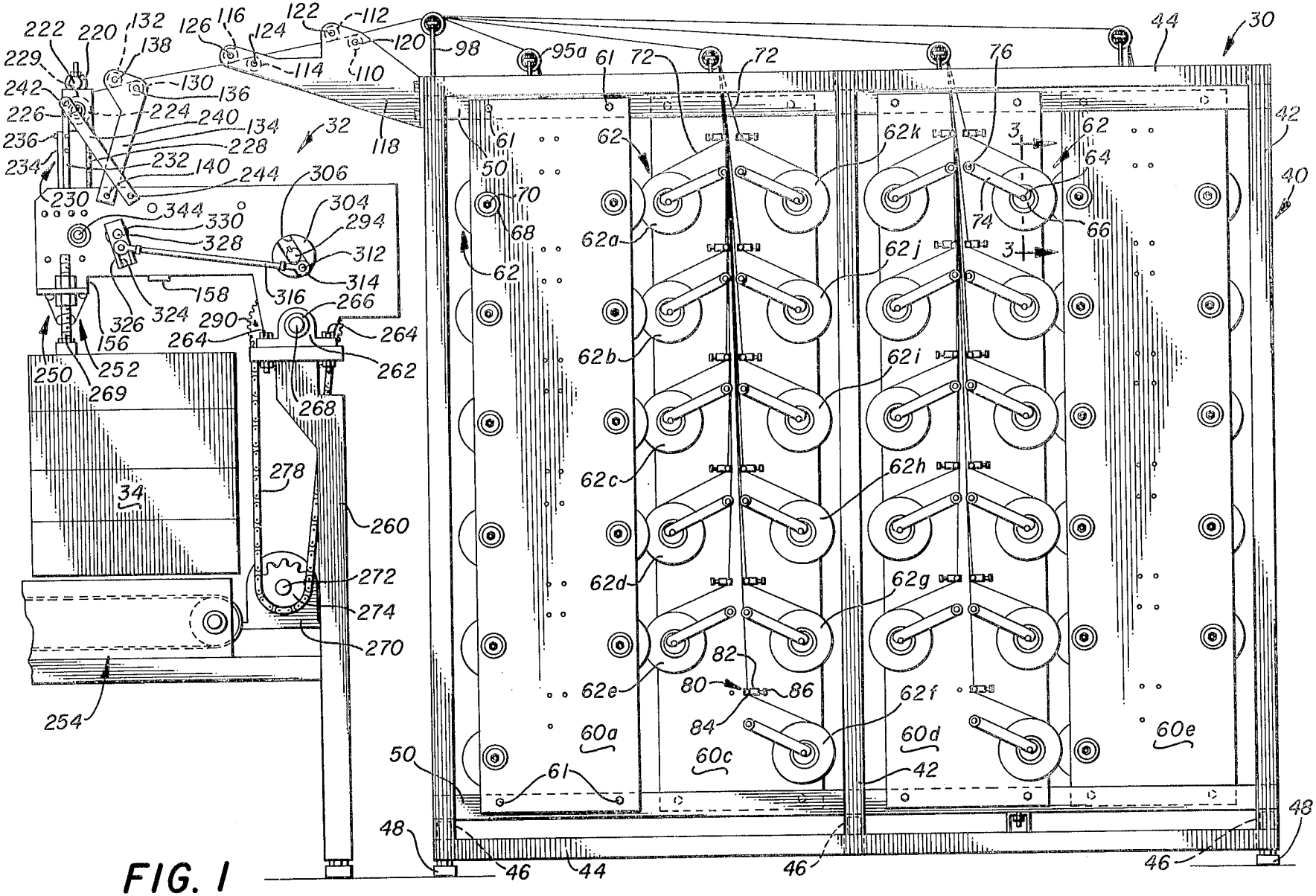
FIG. 1 illustrates a side elevation of the apparatus of the present invention.
Figure 2:
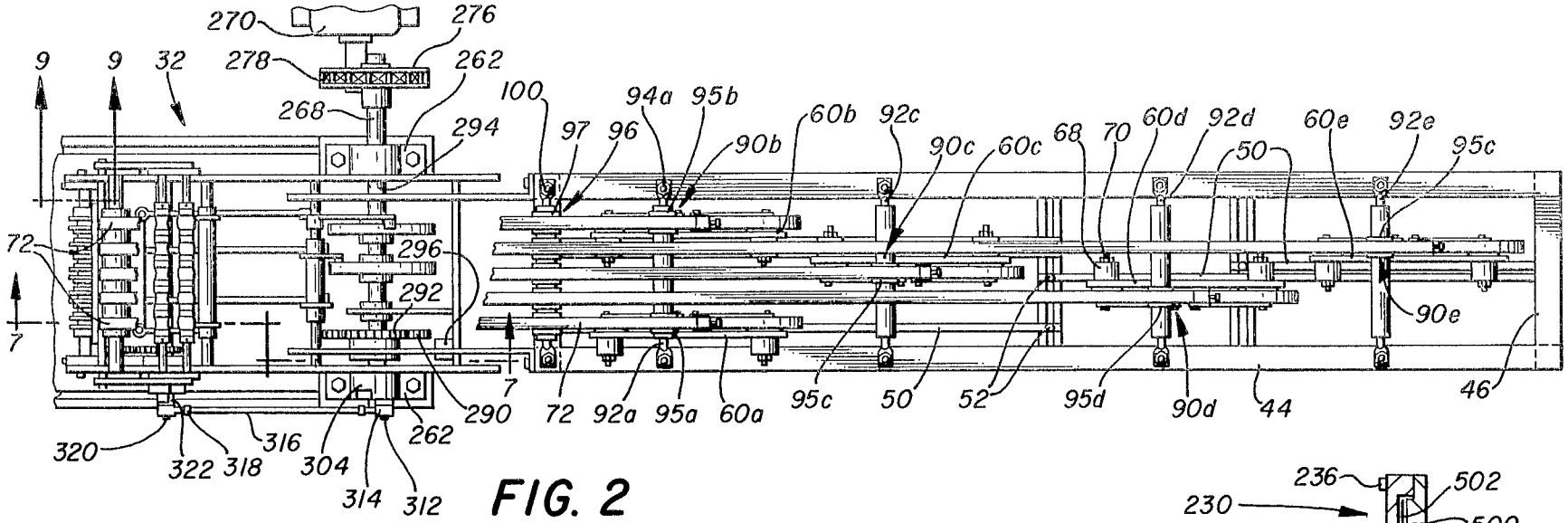
FIG. 2 illustrates a top plan view of the apparatus illustrated in FIG. 1.

Referring to FIGS. 1 and 2, the apparatus for ganging and cutting a plurality of layers of strip material for packaging includes a material supply rack assembly 30, a main head unit 32 and a packaging unit 34. Rack assembly 30 includes a frame 40 having vertical members 42 interconnected by horizontal braces 44 and transverse horizontal members 46. Frame 40 is supported on foot pads 48. A plurality of horizontal support beams 50 are attached between transverse horizontal members 46 by suitable means such as bolts 52. Beams 50 are mounted between members 46 adjacent the upper and lower portions of frame 40 by bolts 52.

A plurality of roll support plates 60 are mounted between beams 50 by attachment of the upper and lower ends of plates 60 to beams 50 by bolts 61. In the preferred embodiment illustrated in FIGS. 1 and 2, five identical roll plates, 60*a*, 60*b*, 60*c*, 60*d*, 60*e*, are used. A plurality of identical supply roll units 62 are attached to each of the roll support plates 60. In the embodiment illustrated in FIGS. 1 and 2, eleven supply roll units 62 are attached to each plate 60. Each roll unit 62 includes a shaft 64 with a hub 66 fixedly attached thereto at one end and with the opposite end passing through plate 60 and secured through a bearing housing 68 by a lock nut 70. A roll of tape 72 is mounted on each hub and is retained thereon by a bar 74 pivotally attached to plates 60 by a pin 76. Bar 74 engages shaft 64 as will be hereinafter described in greater detail.

Figures 3, 4, 5, 6, 7:
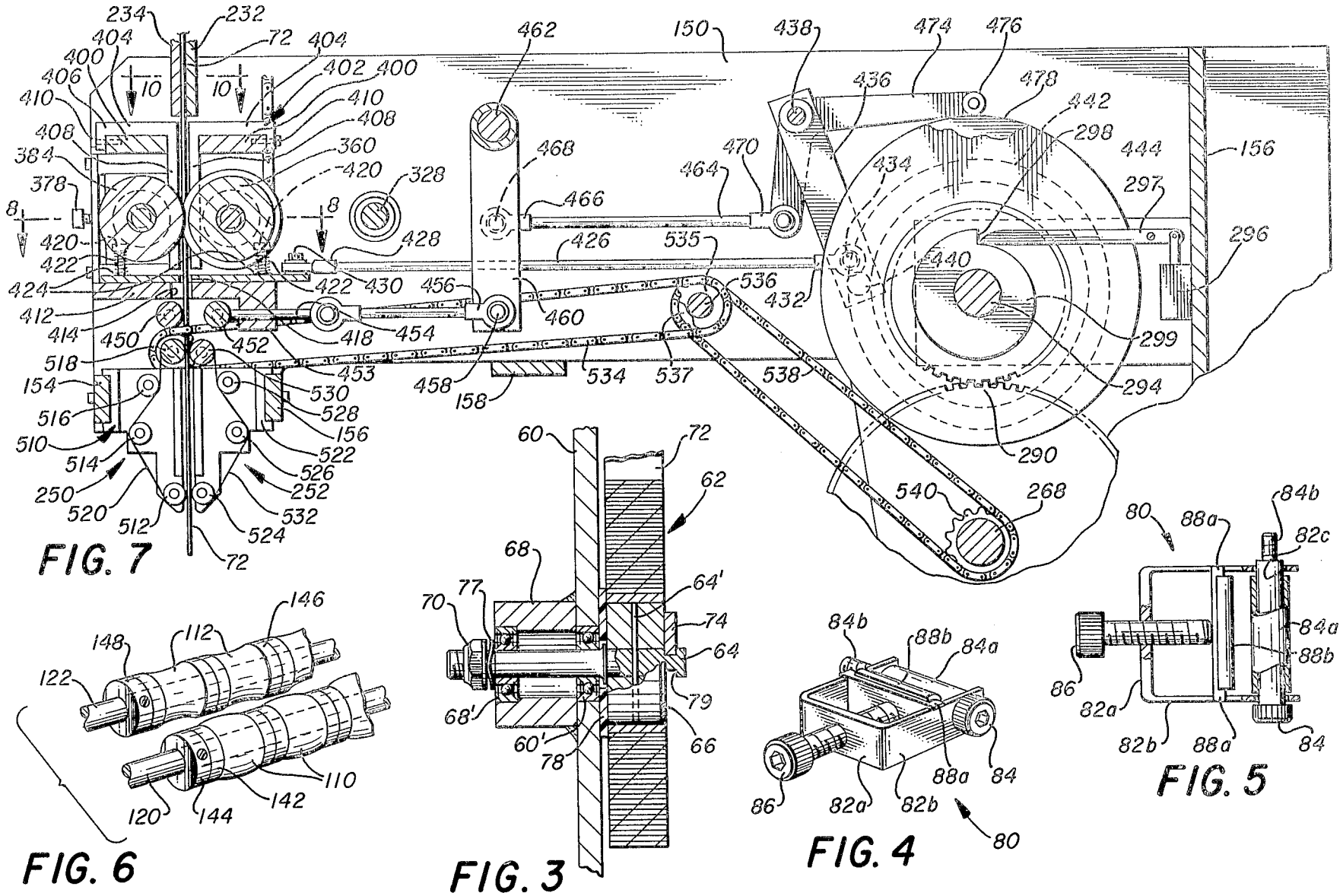
FIG. 3 is a section view taken along line 3—3 of FIG. 1.
FIG. 4 is a perspective view of a tension unit used in the apparatus illustrated in FIG. 1.
FIG. 5 is a top plan view of the tension unit illustrated in FIG. 4.
FIG. 6 is a perspective view of aligning rollers illustrated in FIG. 1.
FIG. 7 is a vertical section taken along line 7—7 of FIG. 2.

Supply roll unit 62 is shown in more detail in FIG. 3. Hub 66 is attached to shaft 64 by a pin 64'. As is seen in FIG. 3, bearing housing 68 is fixedly attached to roll support plate 60 as by welding. Plate 60 receives a ball bearing assembly 60' and bearing housing 68 receives a ball bearing assembly 68'. The outer raceways of bearing assemblies 60' and 68' are pressed into plate 60 and bearing housing 68, respectively. The inner raceways receive shaft 64 therein. A wave washer 77 is engaged over the end of shaft 64, and nut 70 is threaded on shaft 64 to attach the shaft and hub to plate 60 and bearing housing 68. A nylon shim 78 is mounted between hub 66 and plate 60. As nut 70 is engaged on shaft 64, shim 78 is compressed between hub 66 and plate 60. By adjusting nut 70. the friction between shim 78 and hub 66 can be adjusted to vary the rotational resistance on supply roll unit 62. As can be seen in FIG. 3, hub 66 is retained on shaft 64 by the engagement of bar 74 in an annular slot 79 in the end of shaft 64.

Each tape 72 is guided past a tension unit 80 attached to plate 60. Where there are eleven rolls of tape attached to each plate 60, there are likewise eleven tension units 80, one associated with each of the rolls of tape.

FIGS. 4 and 5 illustrate tension unit 80 in greater detail. Referring to FIGS. 4 and 5 in conjunction with FIG. 1, tension unit 80 includes a U-shaped frame 82 having a back wall 82*a* and two legs 82*b* extending therefrom. A bolt 84 is mounted through apertures 82*c* in the ends of legs 82*b* and a sleeve 84*a* is rotatably mounted over the shaft of bolt 84 intermediate of legs 82*b*. The threaded end 84*b* of bolt 84 extends outside of frame 82 for engagement into plate 60. Screw 86 is engaged through a threaded aperture in back wall 82*a* of frame 82 and bears against a slidable bar 88 having projections 88*a* on each end thereof for engagement on both sides of legs 82*b* to retain bar 88 in sliding engagement between legs 82*b*. The face of bar 88 adjacent sleeve 84*a* has a resilient cover 88*b* attached thereto. As can be seen in FIGS. 4 and 5, as screw 86 is engaged through back wall 82*a* of frame 82, it engages slidable bar 88 to force resilient cover 88*b* against sleeve 84*a*.

Referring now to FIGS. 1 and 2, tape 72 from each supply roll unit 62 is engaged between rotating sleeve 84*a* and slidable bar 88 of their respective tension units 80. By adjustment of screw 86, the tape may be selectively gripped between sleeve 84*a* and bar 88. By advancing screw 86, the resistance on the movement of tape 72 through tension unit 80 may be varied as desired.

In the present invention, a plurality of alternating layers of tape or other strip material are ganged for packaging. In the embodiment illustrated, eleven layers of strip material are ganged and packaged together from each of the five roll support plates 60. In one embodiment, these eleven layers of material consist of six layers of typewriter ribbon correcting tape with each layer of tape being separated by separating paper to prevent the correcting tape from adhering to adjacent pieces. To accomplish this arrangement of six tabs of correcting tape each separated by separating paper, roll units 62*a*, 62*c*, 62*e*, 62*g*, 62*i* and 62*k* contain rolls of correcting tape while roll units 62*b*, 62*d*, 62*f*, 62*h*, and 62*j* contain separating paper.

As tapes 72 are unwound from supply roll units 62 on plate 60*a*, they are directed over cylindrical roller 90*a* supported from shaft 92*a* attached to braces 44 by appropriate stud and nut assemblies 94*a*. Roller 90*a* is positioned on shaft 92*a* by side collars 95*a* and tapes 72 are guided over roller 90*a* by collars 95*a*. As the tapes pass over roller 90*a*, eleven layers of tape material are ganged in a stacked relationship for delivery to the head unit. The ganged tapes 72 are directed past roller 90*a* and over one of the cylindrical rollers 96 supported from horizontal brace 44 by a shaft support 98. Shaft support 98 is attached to horizontal brace 44 by suitable stud and nut assemblies 100.

As can be seen in FIG. 2, the roller plates 60*a*, 60*b*, 60*c*, 60*d*, and 60*e* are staggered across the width of frame 40 such that the ganged layers of tape 72 are equally spaced and positioned across the width of the rack assembly. Roller plate 60*b* (FIG. 2) is mounted on frame 40 facing roller plate 60*a* and ganged tapes 72 therefrom are directed over roller 90*b* (FIG. 2) and guided thereover by side collars 95*b*. Likewise, the respective cylindrical rollers 90*c*, 90*d* and 90*e* are aligned on their respective shafts 92*c*, 92*d* and 92*e* to correspond to the position of the tape passing from the individual roller support plates 60*c*, 60*d* and 60*e*. As is also better shown in FIG. 2, rollers 90*c*, 90*d* and 90*e* are positioned on shafts 92*c*, 92*d* and 92*e*, respectively, by side collars 95*c*, 95*d* and 95*e* which are attached to shafts 92 to position rollers 90 in a desired position along the length of the shafts.

As is also better shown in FIG. 2, rollers 96 include five identical rollers 96 separated by appropriate collars 97 which maintain the ganged tape 72 in a desired orientation along the length of shaft support 98.

Referring to FIG. 2, as the layered tapes 72 pass over rollers 96, there are five abreast layers of tape each having eleven layers of material strips therein. Because these rows of layered material are identical and are identically operated on, only one of the rows of layers of tape will be referred to in the following description, it being understood that the operation described includes five rows of identical layered material strips.

As the layers of tape 72 move past rollers 96, they are engaged over convex roller 110 and under concave roller 112. Rollers 110 and 112 both intercept the path of tape 72 such that contact of the tapes 72 with the rollers is assured. Similarly, a convex roller 114 engages the lowermost tape 72 and concave roller 116 engages the uppermost tape. Rollers 110 through 116 are supported from frame 40 by brackets 118 and shafts 120, 122, 124 and 126, adjustably mounted thereto. Tapes 72 then pass over convex roller 130 and concave roller 132 mounted on shafts 136 and 138, respectively, supported by brackets 134. Brackets 134 are mounted to head unit 32 by bolts 140.

Rollers 110 and 112 are shown in greater detail in FIG. 6. As shown in FIG. 6, a plurality of convex rollers 110 having separating cylindrical side portions 142 are mounted on shaft 120 and are retained in position by collar 144. Similarly, concave rollers 112 are formed with a separating cylindrical shoulder 146 and are retained on shaft 122 by collar 148. As can be seen in FIG. 1, rollers 110 and 112 are adjusted such that tapes 72 engage both rollers as they pass therebetween. Similarly, tapes 72 engage both rollers 114 and 116 and rollers 130 and 132 as they pass therebetween. In the preferred embodiment of the invention, where five rows of layered tape material are directed to head unit 32, there are an equal number of rollers 110 and 112 each corresponding to one of the rows of tape material 72. similarly, rollers 114 and 116 and rollers 130 and 132 correspond in number to the number of rows of layered tape from the rack assembly.

After tapes 72 progress past rollers 132, they are directed into head unit 32. Head unit 32 includes side walls 150 separated by bar 152 at one end and bars 154 and 156 at the forward end. Bar 158 is also attached between side walls 150 intermediate of the front and rear of the unit.

Tapes 72 are directed into head unit 32 past rollers 132 between cylindrical rollers 220 carried on shaft 222 and roller 224 mounted for rotation on shaft 226. Shaft 226 and rollers 224 mounted thereon are driven by chain 228 acting on gear 229 as will hereinafter be discussed in greater detail. Tapes 72 are then directed into a guide plate assembly 230 having a back plate 232 and a top plate 234 mounted thereon by bolts 236. Guide plate assembly 230 is supported from side walls 150 by a strap 240 attached at its upper end to guide plate assembly 230 by bolts 242 and at the lower end by bolts 244 to side walls 150. Tapes 72 are directed into head unit 32 where they are severed into predetermined lengths as will hereinafter be described in greater detail. Thereafter, the severed multilayered tapes are moved downwardly by belt assemblies 250 and 252. The severed tapes then move into packaging unit 34 where the severed tapes are packaged into individual units and discharged onto conveyor unit 254.

The packaging unit 34 does not comprise a portion of the present invention and thus is not described in detail. A packaging unit such as one produced by Production Packaging Machinery Co. of Passaic, New Jersey may be incorporated with the present invention to accomplish the packaging of the severed tapes.

Head unit 32 is supported by a leg support 260. Support 260 receives pillow blocks 262 attached to support 260 by bolts 264. Pillow blocks 262 house bearing structures 266 for receiving the opposite ends of shaft 268 therein. Shaft 268 passes through pillow blocks 262 and side walls 150 to which pillow blocks 262 are fixedly attached. The forward end of head unit 32 is supported above packaging unit 34 by legs 269 mounted from side walls 150.

Referring still to FIGS. 1 and 2, a motor 270 is supported below head unit 32 and has a shaft 272 extending therefrom. Shaft 272 drives a sprocket wheel 274 which in turn drives a sprocket wheel 276 (FIG. 2) by way of chain 278. Sprocket wheel 276 is attached to shaft 268 and drives shaft 268 when motor 270 is operating.

A gear 290 is also attached to shaft 268 for rotation therewith. Gear 290 engages a smaller gear 292 (FIG. 2) for driving shaft 294 (FIGS. 1 and 2). Gear 292 normally drives shaft 294 by way of a clutch therebetween (not shown).

A solenoid 296 is operated by a timed controller (not shown) to pivot arm 297 for engagement in notch 298 of a hub 299. Hub 299 is attached for rotation with shaft 294. When arm 297 is engaged in notch 298, the rotation of hub 299 is arrested as is the rotation of shaft 294. Gear 292 continues to turn and rotates shaft 294 when arm 297 is raised out of engagement with notch 298. In this way, solenoid 296 controls the rotation of shaft 294 as desired.

As shaft 294 rotates, a hub 304 attached to the end of the shaft outside of side wall 150 is also rotated. Hub 304 has a slot 306 in one face for adjustably receiving a block 310 within slot 306. A shaft 312 extends outwardly from block 310. Shaft 312 is pivotally engaged within eye bolt end 314 of shaft 316. The ooposite end of shaft 316 is fitted with an eye bolt end 318 for pivotally engaging a shaft 320 of an adjustable attachment bolt 322 extending from slot 324 of arm 326. Arm 326 engages a shaft 328 through a one-way clutch such that when arm 326 is rotated clockwise (as seen in FIG. 1), shaft 328 is driven. When arm 326 is rotated counterclockwise (as seen in FIG. 1) shaft 328 is not driven. Shaft 328 is rotatably received through side walls 150 at bearing assemblies 330.

Referring to FIG. 2, a gear 340 is attached to and rotates with shaft 328. Gear 340 meshes with gear 342 adjacent thereto and attached to shaft 344 (FIG. 1). Shaft 344 has its ends mounted between side walls 150.

Figure 8:
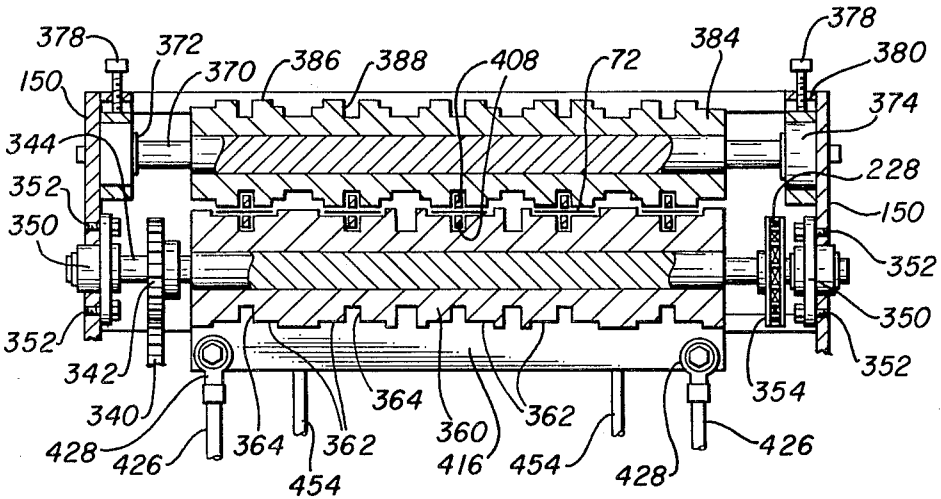
FIG. 8 is a section view taken along line 8—8 of FIG. 7.

FIG. 7 illustrates the interior of head unit 32 in greater detail. As has been previously discussed, side walls 150 are maintained in a spaced and separated relationship by transverse bars 152, 154, 156 and 158. Referring to FIGS. 7 and 8, shaft 334 is supported for rotation between side walls 150 in bearing assemblies 350 attached to side walls 150 by bolts 352. Gear 342 is attached to shaft 344 and is engaged by gear 340 driven on shaft 328. A gear 354 is attached to shaft 344 on the opposite end from that on which gear 342 is attached. Chain 228 engages gear 354 for driving roller 224 (FIG. 1). A drive roller 360 is attached to shaft 344 for rotation therewith. Roller 360 is formed with a plurality of annular slots 362 and annular notches 364 therein.

In one embodiment of the invention, gears 354 and 229 are identical such that shafts 344 and 226 rotate at the same angular velocity. Further, the diameter of roller 224 has a diameter equal to the diameter of the outer surface of slots 362 of roller 360. Thus, the angular velocity of the surface of roller 224 matches the angular velocity of the outer surface of slots 362 of roller 360.

Figure 9:
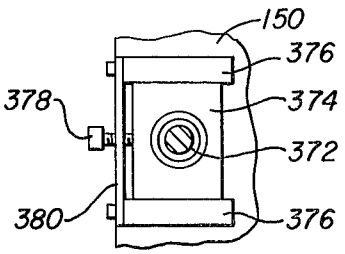
FIG. 9 is a partially broken away section view taken along line 9—9 of FIG. 2.

Referring to FIGS. 8 and 9, roller shaft 370 is mounted for rotation in a parallel relationship to shaft 344 between side walls 150. The ends of shaft 370 are mounted in bearing assemblies 372 which are in turn mounted in adjustable blocks 374. Blocks 374 are slidably received between guides 376 (FIG. 9). Blocks 374 are adjustable inwardly by screws 378 engaged between end plates 380 and blocks 374. By advancing screws 378, blocks 374 are engaged inwardly to adjust shaft 370 toward shaft 344. A driven roller 384 is attached to shaft 370 and rotates therewith. Driven roller 384 includes a plurality of annular shoulders 386 which correspond to the annular slots 362 in roller 360. Roller 384 further includes a plurality of annular notches 388.

Adjustment of roller 384 in engagement with roller 360 is accomplished by advancing screws 378 through plates 380. As screws 378 are advanced, blocks 374 are forced toward roller 360. Through this adjustment, roller 384 is engaged against roller 360 with shoulders 386 of roller 384 engaging slots 362 of roller 360. Shoulders 386 are greater in height than the depth of slots 362. Also the width of shoulders 386 is slightly less than the width of slots 362. As a result, contact between roller 384 and roller 360 is between the outermost surface of shoulders 386 and the bottom surface of slots 362. For purposes of clarity only, FIG. 8 illustrates the outer surface of shoulders 386 as spaced from the corresponding bottom surface of slots 362. It will be understood that for operation of the present invention, shoulders 386 are forced into slots 362 to engage the plurality of layers of tape 72 therebetween.

Referring still to FIG. 8, tapes 72 are directed between drive roller 360 and driven roller 384 and engaged between shoulders 386 and slots 362. This engagement of tapes 72 between rollers 360 and 384 acts to draw tapes 72 downwardly into head unit 32. Further, the engagement between drive roller 360 and driven roller 384 rotates driven roller 384.

Referring to FIGS. 7 and 8, a pair of guide finger bars 400 are attached between side walls 150 and support a plurality of guide fingers 402 thereon. Referring to FIG. 7, guide fingers 402 include a back 404 with two legs 406 and 408 extending downwardly therefrom. Fingers 402 are attached to bars 400 by suitable screws 410 as shown in FIG. 7. Legs 408 extend downwardly between rollers 360 and 384 in the notches 364 and 388 provided therein (FIG. 8). As can be seen in both FIGS. 7 and 8, tapes 72 pass between legs 408 of guide fingers 402. These legs serve as a guide as well as a barrier on both sides of tapes 72 to prevent any of the tapes from adhering to and following rollers 360 and 384.

Referring to FIG. 7, a stationary cutter plate 412 is mounted between side walls 150. Plate 412 has a slot 414 of sufficient width and length to receive tapes 72 therethrough. A movable upper cutter plate 416 is attached above plate 412. Plate 416 has a slot 418 substantially corresponding with slot 414 of plate 412 although of narrower width than slot 414. Plate 416 is slidably engaged to plate 412 by appropriate bolts 420, springs 422 and washers 424 on which springs 422 act. Plate 416 is slotted to receive bolts 420 therethrough with bolts 420 engaged to stationary plate 412. Springs 422 bias plate 416 toward plate 412. With this arrangement, movable cutter plate 416 may be slid relative to lower plate 412 to sever tapes 72 between the edges of the walls defining slots 414 and 418.

Referring now to FIGS. 7 and 8, upper plate 416 is moved relative to plate 412 by a series of linkages and a cam action controlled by the rotation of shaft 294. Shafts 426 have a bearing end 428 attached to plate 416 by bolts 430. The opposite ends of shafts 426 are attached by appropriate fittings 432 and pins 434 to arm 436 pivoting from shaft 438 suspended between side walls 150. Arm 436 has a cam follower 440 received within cam track 442 of cam 444 attached for rotation with shaft 294. As shaft 294 rotates, cam follower 440 moves in cam track 442 to pivot arm 436 fore and aft to sever tapes 72.

Referring to FIG. 7, a fixed in place nipper bar 450 is rotatably mounted to one side of the path of tapes 72 and between side walls 150. A second nipper bar 452 is rotatably supported on the opposite side of the path of tapes 72 from arms 454 extending through guides 453. Arms 454 are attached between nipper bar 452 and idler arms 460. Arms 454 are attached to idler arms 460 by appropriate fittings 456 and pins 458. The opposite ends of idler arms 460 rotate on a shaft 462 supported between side walls 150. The movement of idler arms 460 is controlled by shaft 464 attached at fitting 466 and pin 468 to idler arm 460 and at the opposite end by fitting 470 and pin 472 to a cammed arm 474. Arm 474 is also pivoted from on shaft 438 and has a cam follower 476 for riding on the outer surface of a cam 478 fixed for rotation on shaft 294. The design of cam 478 is such that just prior to the movement of upper cutter plate 416 to sever tapes 72, movable nipper bar 452 is engaged against rotating in place nipper bar 450 with tapes 72 therebetween. This engagement of tapes 72 by nipper bars 450 and 452 acts to stabilize the tape during severing.

Figure 10:
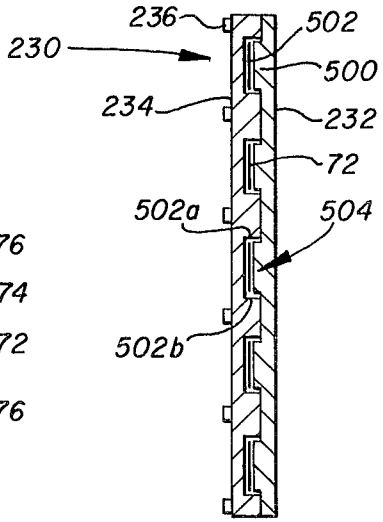
FIG. 10 is a section view taken along line 10—10 of FIG. 7.

FIG. 10 illustrates a cross-sectional view of the guide plate assembly positioned immediately ahead of the drive and driven rollers 360 and 384, respectively. As described earlier, guide plate assembly 230 includes a back plate 232 with top plate 234 attached thereto by bolts 236. Back plate 232 includes a plurality of raised shoulders 500 corresponding to slots 502 formed in top plate 234. Shoulders 500 are slightly shorter in height than the depth of slots 502 and slightly narrower in width than that of slots 502. In this way, top plate 234 may be engaged on back plate 232 with a slight gap between the outer surface of shoulder 500 and the bottom exposed surface of slot 502. This gap, designated by the numeral 504, receives the plurality of layers of tape 72 therethrough. As can be seen in FIG. 10, gap 504 is formed between shoulder 500 and slot 502 with side walls **502*a* and 502*b* of slot 502 serving as side boundaries of gap 504. The multiple layers of tapes 72 are free to move throughbut are restrained from lateral movement as they pass through gaps 504 of guide plate assembly 230**.

Referring to FIG. 7, the multiple layers of tape passing from guide plate assembly 230 are directed between guide fingers 402 and then engage between drive roller 360 and driven roller 384. The multiple layers of tape are then directed through slots 414 and 418 of plates 412 and 416, respectively, and into engagement between belt assemblies 250 and 252. Belt assembly 250 includes a frame 510 supported from bar 154 and having a plurality of rollers 512, 514, and 516 rotatably attached thereto. A roller bar 518 is attached between side walls 150 and a conveyor band 520 is entrained around rollers 512, 514 and 516 and roller bar 518. Belt assembly 252 similarly includes a frame 522 attached to bar 156 and supports rollers 524, 526 and 528 for rotation thereon. A second roller bar 530 is supported between side walls 150 in a parallel relationship to roller bar 518. A conveyor band 532 is entrained around rollers 524, 526, 528 and roller bar 530.

Roller bar 518 is rotated by chain 534 driven by sprocket wheel 535 on shaft 536. Shaft 536 is driven from shaft 268 through chain 538 entrained around sprocket wheels 537 and 540 on shafts 536 and 268, respectively. Roller bar 530 is driven by bar 518 through appropriate gearing not shown.

As is shown in FIG. 7, the multiple layers of tape 72 pass through the slots in cutter plates 412 and 416 into engagement between bands 520 and 532 of belt assemblies 250 and 252, respectively. After the tapes 72 are severed by the action of plates 412 and 416, the tapes are engaged between bands 520 and 532 and moved downwardly into packaging unit 34. Rotation of bands 520 and 532 is accomplished by the rotation of roller bars 518 and 530 which are driven in unison with shaft 344 of roller 360.

In operation of the present invention illustrated in FIGS. 1 through 10, tape is mounted in the form of continous rolls on roll plates **60*a*, 60*b*, 60*c*, 60*d* and 60*e*. In the disclosed embodiment, 11 rolls of tape are mounted on each roll plate. Referring to FIG. 3, a roll of tape is mounted on hub 66 to which shaft 64 is fixedly attached. Shaft 64 is inserted through plate 60 and bearing housing 68 through ball bearing assembly 60' and 68' with a shim 78 positioned between hub 66 and plate 60. Nut 70 is engaged on the threaded end of shaft 64 with wave washer 77 positioned between nut 70 and bearing assembly 68'. Referring to FIG. 1, retaining bar 74 is pivoted about pin 76 and engaged in slot 79 (FIG. 3) on the end of shaft 64 to retain the roll of tape on hub 66. Nut 70 is tightened to draw in hub 66 toward plate 60 to engage shim 78 therebetween. By advancing nut 70 on shaft 64, the friction between hub 66, shim 78 and plate 60 may be controlled to vary the tension required to rotate shaft 64 and to let out tape 72**.

In accordance with one embodiment of the invention, typewriter ribbon correcting tape is used at roller units **62*a*, 62*c*, 62*e*, 62*g*, 62*i* and 62*k* with separating paper being used at roller units 62*b*, 62*d*, 62*f*, 62*h*, and 62*j*. With this arrangement, the final ganging of tapes 72** will result in alternating layers of typewriter ribbon correcting tape and separating paper.

Each tape 72 is drawn from roller units 62 and threaded between bar 88 and sleeve **84*a* of tension unit 80. As can be seen in FIG. 1, tape from the lower roller units, such as roller unit 62*f*, is guided upwardly through its respective tension unit 80 and then to the outside of sleeve 84*a* of tension units 80 associated with other of the roller units 62**.

The eleven strips of tape material are then directed in a layered relationship over cylindrical roller **90*b* between side collars 95*b*. From this point, each of the five ganged layers of tape is drawn forward over cylindrical roller 96 between collars 97 such that each of the five rows is equally spaced one from the other and in line with the supply roll units staggered across the width of supply rack assembly 30**. The ganged layers of tape are then directed through three sets of roller assemblies having a concave roller contacting the lowermost tape in the layer and a convex roller contacting the uppermost layer of tape. The concave and convex rollers are adjustable to permit varied amounts of deflection of the ganged layers of tape from a straight line path. By adjusting these rollers, and as a result of their contact with the multiple layers of tape, the ganged layers are maintained in an on-line path.

The layers of tape are then directed over roller 224 and into guide plate assembly 230 where the layers of material are guided through gap 504 formed between back plate 232 and top plate 234. As the layers of tape exit guide plate assembly 230, they are directed between guide fingers 402 for engagement between drive roller 360 and driven roller 384.

As motor 270 is energized to rotate sprocket wheel 274, chain 278 is driven to rotate shaft 268 through sprocket wheel 276. The rotation of shaft 268 rotates gear 290 attached thereto. Gear 290 engages gear 292 to rotate shaft 294. The rotation of shaft 294 is in a clockwise direction as seen from FIG. 1. Hub 304 is likewise rotated in a clockwise direction and in turn drives shaft 316 attached thereto by eye bolt end 314 at shaft 312. Adjustment of the eccentric position of shaft 312 by moving block 310 within slot 306 of hub 304 varies the length of movement of shaft 316. The movement of shaft 316 in turn rocks arm 326 fore and aft about the axis of shaft 328. Because arm 326 is engaged to shaft 328 by a one-way clutch, shaft 328 is rotated only in a clockwise direction at intermittent periods.

The angular rotation of shaft 328 may also be adjusted by adjusting the position of bolt 322 in slot 324 of arm 326. By increasing the eccentric position of bolt 322 from the axis of shaft 328, the angular rotation of shaft 328 will be decreased. Conversely, by shortening the eccentric position of bolt 322 relative to the axis of shaft 328, the angular rotation of shaft 328 will be increased.

As shaft 328 is rotated in a clockwise direction as viewed in FIG. 1, gear 342 is driven to rotate shaft 344. As a result, drive roller 360 is rotated in a counterclockiwse direction as viewed in FIGS. 1 and 3, and the engagement of the layers of tape pinched between drive roller 360 and driven roller 384 draws the layers of tape downwardly into the slots in cutter plates 412 and 416. The action of upper cutter plate 416 relative to lower cutter plate 412 severs the layers of material is predetermined lengths. By adjusting the angular rotation of drive roller 360 by varying the driving linkages, the length of tapes moved through each cutting cycle may be varied and thus the lengths of the severed tapes may be adjusted as desired.

Prior to severing of the layers of tape, nipper bar 452 is engaged against in place nipper bar 450 and holds the layers of tape taut during severing of the tapes. After a predetermined length of tape has been severed, it is engaged between belt assemblies 250 and 252 where it is directed downwardly into packaging unit 34 where the ganged layers of correcting tape and separating papers are packaged. These packages are then dropped onto conveyor unit 254 where they are carried to a subsequent boxing station.

Although the tension on tapes 72 is controlled by adjustment of nut 70 on roller units 62, a more accurate tensioning on tapes 72 is accomplished by tension units 80. This adjustment is made by engaging screw 86 to force bar 88 against sleeve 84*a* to grab tape therebetween. This adjustment is independent of the effective radius of the tape roll and can provide a constant tension throughout the operation of the present apparatus.

Figure 11:
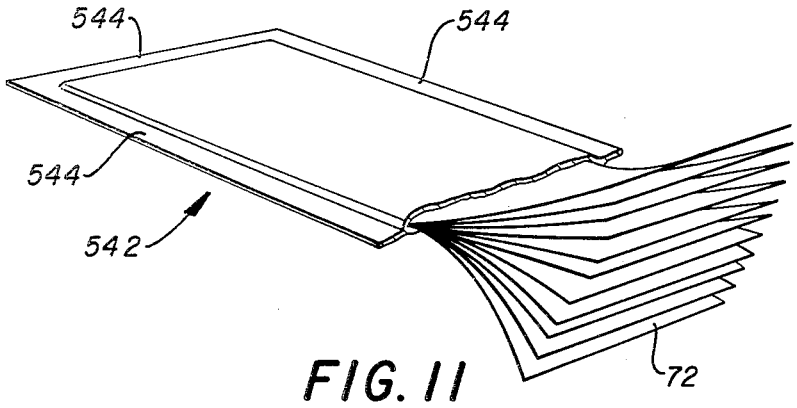
FIG. 11 is a perspective view of the product produced by the apparatus of the present invention with the package opened to expose the layers of material therein.

FIG. 11 illustrates a completed package embodying the multiple layers of tapes 72 with a portion of the package broken away to show these inner layers. As is shown in FIG. 11, the package 542 is formed with sealed edges 544 around the periphery of the package.

Figure 12:
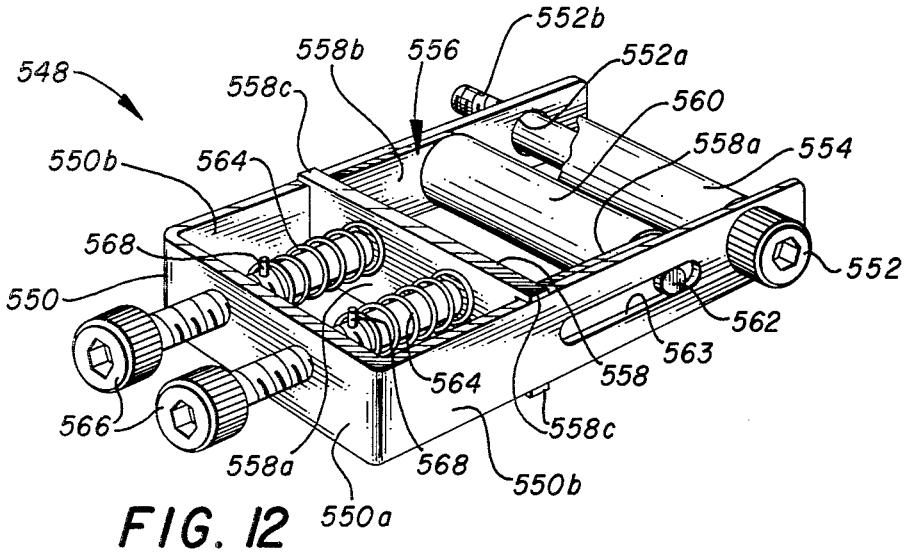
FIG. 12 is a perspective view of an alternative embodiment of the tension unit illustrated in FIGS. 4 and 5.

FIG. 12 illustrates an alternative embodiment of the tension unit illustrated in FIGS. 4 and 5. A tension unit 548 includes a U-shaped frame 550 having a back wall 550*a* and two parallel side legs 550*b* extending from back wall 550*a*. A bolt 552 is mounted through apertures 552*a* in the ends of legs 550*b*, and a sleeve 554 is rotatably mounted over the shaft of bolt 552 intermediate of legs 550*b*. The threaded end 552*b* of bolt 552 extends outside the frame 550 for engagement into plate 60 in the place of tension unit 80 described in conjunction with FIGS. 4 and 5.

A movable roller assembly 556 is mounted within frame 550 and includes a U-shaped frame 558 having a back wall 558*a* and two side legs 558*b* extending therefrom. A rolling element 560 is rotatively supported between side legs 558*b* on a shaft 562. Shaft 562 extends outside of side legs 558*b* and into slots 563 in side legs 550*b* of U-frame 550.

Projections 558*c* extend from frame 558 to each side of legs 550*b* of U-frame 550 to permit sliding engagement between roller assembly 556 and U-shaped frame 550. A pair of springs 564 are attached to back wall 558*a* of frame 558 and are engaged by screws 566 threaded through back wall 550*a* of frame 550. The end of screws 566 protruding through back wall 550*a* is engaged within springs 564. Pins 568 mounted through screws 566 engage the top of springs 564.

In this embodiment, tension unit 548 can be adjusted to engage the plurality of ganged tapes between sleeve 554 and rolling element 560 by advancing screw 566 into frame 550. As screw 566 is advanced, springs 564 increase the force of roller 560 against sleeve 554 by forcing roller assembly 556 toward sleeve 554. In this embodiment, splices of the tape material may more easily pass between sleeve 554 and rolling element 560. Further, uniform force is maintained over the full length of the rollers by providing a pair of spring and bolt assemblies for engaging roller 560 against sleeve 554.

Figure 13:
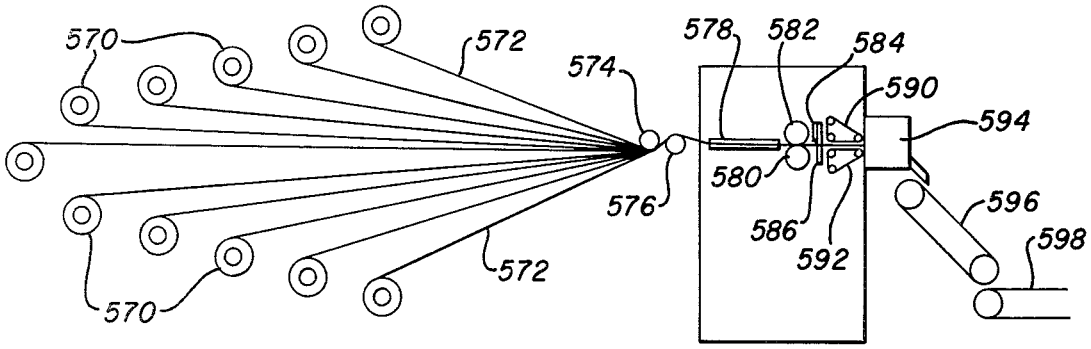
FIG. 13 is a schematic representation of alternative form of the apparatus illustrated in FIGS. 1–10.

FIG. 13 illustrates an alternative arrangement of the supply rack relative to the head unit in schematic form. In the embodiment in FIG. 13, a plurality of roller units 570 each is loaded with a roll of tape 572 and is positioned in a common plane. Tape 572 is unwound from roller units 570 and is fed directly into contact with a convex roller 574 and then a concave roller 576 both of which are in the path of travel of tapes 572. Again, the operation of the concave and convex roller is to maintain the tapes 572 on track and in alignment one with the other. Immediately after the point of contact with convex roller 576, the ganged layers of tape are directed through a guide assembly 578 similar to guide assembly 230 discussed with respect to the embodiment illustrated in FIGS. 1 through 10. Thereafter, the ganged layers of material are engaged between a drive roller 580 and a driven roller 582 similar in operation to drive roller 360 and driven roller 384 of the first described embodiment.

The layers of tape are severed by the action of a movable cutter plate 584 against a stationary cutter plate 586 similar in operation to cutter plates 416 and 412 discussed in the earlier described embodiment. The severed layers of tape are engaged between belt assemblies 590 and 592 similar in construction and operation to belt assemblies 250 and 252 in the earlier described embodiment. The severed layers of material are packaged in a packaging unit 594 and directed to conveyors 596 and 598 for transfer to a boxing station.

The embodiment in FIG. 13 provides the advantage of permitting tapes 572 to move substantially along a single axis into and through the head unit where the tapes are severed and directed into the packaging unit. In this arrangement, the problems associated with making turns with the layers of material are avoided.

Therefore, the present invention provides an apparatus for ganging and cutting a plurality of layers of strip material in predetermined lengths. The apparatus includes a frame supporting drive and driven rollers acting together to draw the layers of material to a cutter where the layers are severed. The drive roller, acting with the driven roller, draws a plurality of layers of material from a rack structure where each layer is individually wound on a rotatable roll. Each layer of strip material is drawn from a roll and a plurality of layers are ganged over a cylindrical roller.

The ganged layers of material are directed over a series of convex-concave roller combinations to maintain alignment of the layers one over the other. The layers of material are then drawn over an upper support roller and are guided to the drive roller through a guide plate structure. The guide plate structure includes a back plate having a slot therein and a top plate having a longitudinal shoulder corresponding to the slot. The layers of material are maintained within the slot of the back plate to prevent lateral movement by the layers. The layers of material are engaged between the drive and driven roller and directed to a cutting station where the layers of strip material are cut for later packaging. Structure is provided for tensioning each layer of strip material to eliminate binding between the various layers.

Although preferred embodiments to the invention have been described in the foregoing Detailed Description and illustrated in the accompanying Drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the appended claims.

What is claimed is:

1. An apparatus for ganging and cutting multiple rows of a plurality of layers of strip material in predetermined lengths, comprising:

a frame, a guide plate means supported by said frame and having a plurality of channels corresponding to said plurality of layers of strip material for receiving the rows of layered strip material therein and preventing the lateral movement of the plurality of layers of material, a drive roller supported by said frame below said guide plate means, a driven roller supported adjacent said drive roller and in engagement therewith for grabbing the layers of material therebetween to draw the layers of material beyond said drive roller, and a cutter means supported by said frame below said drive and driven rollers for severing said layers of material in predetermined lengths.

2. The apparatus according to claim 1 further comprising:

an upper roller supported by said frame for directing the strip material therearound and into said guide plate means.

3. The apparatus according to claim 2 wherein said upper roller includes a cylindrical drum and wherein said drive roller includes a drum having a receiving slot substantially corresponding in width to the width of the layers of strip material for receiving the layers therein, said upper roller having a diameter substantially identical to the diameter of said drive roller at the surface of the receiving slot, and means for driving said upper roller at the same rotational speed of said drive roller.

4. The apparatus according to claim 1 wherein said drive roller includes an annular receiving slot substantially corresponding to the width of the strip material, and wherein said driven roller has an annular shoulder slightly narrower in width than the receiving slot in said drive roller and slightly higher than the depth of the slot so that the outer surface of the annular shoulder engages the bottom of the receiving slot of said drive roller to pinch the layers of strip material therebetween and draw the strip material through said drive and driven rollers.

5. The apparatus according to claim 1 further comprising:

nipper means positioned below said cutter means for engaging the strip material therebetween, and means for operating said nipper means to engage the strip material prior to severing the material in the predetermined lengths.

6. An apparatus for ganging and cutting a plurality of layers of strip material in predetermined lengths, comprising:

a frame, a guide plate means supported by said frame for receiving the layers of strip material therethrough and preventing the lateral movement of the plurality of layers of material, a drive roller supported by said frame below said guide plate means, a driven roller supported adjacent said drive roller and in engagement therewith for grabbing the layers of material therebetween to draw the layers of material beyond said drive roller, a cutter means supported by said frame below said drive and driven rollers for severing said layers of material in predetermined lengths, and finger guides supported on opposite sides of the strip material adjacent said drive and driven rollers to prevent the strip material adhering to said drive and driven rollers as the strip material passes therebetween.

7. The apparatus according to claim 6 wherein said finger guides include elongated members positioned adjacent the surface of said drive and driven rollers and extending from above to below said rollers.

8. An apparatus for ganging and cutting a plurality of layers of strip material in predetermined lengths, comprising:

a frame, a guide plate means supported by said frame for receiving the layers of strip material therethrough and preventing the lateral movement of the plurality of layers of material, wherein said guide plate means includes a back plate having a longitudinal slot formed therein corresponding to the width of the strip material and deeper than the thickness of the layers of material, a top plate having a longitudinal shoulder corresponding to the groove in said back plate, said shoulder being shorter in height than the depth of said slot, means for attaching said top plate to said back plate with said shoulder engaging said slot such that the layers of strip material are guided between said back plate and top plate within the slot in said back plate, a drive roller supported by said frame below said guide plate means, a driven roller supported adjacent said drive roller and in engagement therewith for grabbing the layers of material therebetween to draw the layers of material beyond said drive roller, and a cutter means supported by said frame below said drive and driven rollers for severing said layers of material in predetermined lengths.

9. The apparatus according to claim 1 further comprising:

rack means for supporting a plurality of rolls each with one of the layers of material thereon, and means for supporting said rack adjacent said guide plate means for feeding said strip material from said rolls in a layered orientation to said plate means, said support means positioned relative to said guide plate means such that said strip material moves substantially along a straight line from the material rolls to said guide plate means.

10. The apparatus according to claim 1 further comprising:

rack means for supporting a plurality of rolls each with one of the layers of material thereon, roller guide means for receiving the layers of material thereover in a stacked relationship, and second roller guide means for receiving the layers of material thereover to maintain the alignment of the stacked layers of strip material, said second roller guide means being aligned between said rack means and said guide plate means.

11. The apparatus according to claim 10 wherein said rack means includes:

a frame, a plate attached to said frame, and a plurality of rolls rotatively attached to said plate, said rolls each having one of the strips of material wound thereon.

12. The apparatus according to claim 10 wherein said roller guide means includes:

a shaft, a cylindrical roller on said shaft, and a pair of side collars supported on said shaft on opposite sides of said roller, said strip material passing over said roller in between said collars.

13. The apparatus according to claim 10 wherein said second guide means includes a convex roller spaced from a concave roller with said rollers in contact with and on opposite sides of the layers of strip material as the layers move from said rack means to said guide plate means.

14. The apparatus according to claim 1 further comprising:

rack means for supplying the layers of material therefrom, and a roller guide means aligned between said rack means and said guide plate means and including a convex roller spaced from a concave roller with said rollers in contact with and on opposite sides of the layers of materials as the layers of material move from said rack means to said guide plate means.

15. The apparatus according to claim 1 further comprising:

a tension means mounted remote from said drive roller for tensioning the strip material as it is drawn by said drive roller.

16. An apparatus for ganging and cutting a plurality of layers of strip material in predetermined lengths, comprising:

a frame, a guide plate means supported by said frame for receiving the layers of strip material therethrough and preventing the lateral movement of the plurality of layers of material, a drive roller supported by said frame below said guide plate means, a driven roller supported adjacent said drive roller and in engagement therewith for grabbing the layers of material therebetween to draw the layers of material beyond said drive roller, a cutter means supported by said frame below said drive and driven rollers for severing said layers of material in predetermined lengths, and a tension means mounted remote from said drive roller for tensioning the strip material as it is drawn by said drive roller, wherein said tension means includes a frame, a cylinder mounted on said frame for receiving the strip material therearound, and a movable bar adjustable relative to said cylinder for engagement of the strip material between said bar and said cylinder to restrict movement of the strip material past said cylinder thereby tensioning the strip material as it is drawn by said drive roller.

17. An apparatus for ganging and cutting a plurality of layers of strip material in predetermined lengths, comprising:

a frame, a guide plate means supported by said frame for receiving the layers of strip material therethrough and preventing the lateral movement of the plurality of layers of material, a drive roller supported by said frame below said guide plate means, a driven roller supported adjacent said drive roller and in engagement therewith for grabbing the layers of material therebetween to draw the layers of material beyond said drive roller, a cutter means supported by said frame below said drive and driven rollers for severing said layers of material in predetermined lengths, and a tension means mounted remote from said drive roller for tensioning the strip material as it is drawn by said drive roller, wherein said tension means comprises a U-shaped frame having a base leg with two side legs extending therefrom, a cylinder supported between the side legs remote from the base leg for receiving the strip material therearound, a bar having guide structure on its ends for slidable engagement on said side legs, and screw means acting between the base leg of said U-shaped frame and said bar for selectively moving said bar against said cylinder to engage the strip material between said bar and said cylinder thereby applying tension to the strip material as it is drawn by said drive roller.

18. The apparatus according to claim 17 further comprising:

a resilient pad attached to said bar adjacent said cylinder such that the strip material is engaged between said pad and said cylinder as said bar is moved toward said cylinder.

19. The apparatus according to claim 18 further comprising:

rack means for supporting a plurality of rolls each with one of the layers of material thereon, and a shaft mounted through the side legs of said U-shaped frame and through said cylinder, said shaft having one end engaged into said rack means on which said rolls are attached.

20. An apparatus for ganging and cutting a plurality of layers of strip material in predetermined lengths, comprising:

a frame, a drive roller supported by said frame and having an annular receiving slot substantially corresponding to the width of the layers of strip material for receiving the layers of material therein, a driven roller supported adjacent said drive roller and having an annular shoulder for engaging the bottom of the receiving slot of said drive roller to pinch the layers of strip material therebetween, means for driving said drive roller to draw the strips of material between said drive and driven rollers, and cutter means supported by said frame below said drive and driven rollers for severing said layers of material in predetermined lengths, an upper roller supported by said frame for directing the strip material therearound and between said drive and driven rollers, said upper roller including a cylindrical drum having a diameter substantially identical to the diameter of said drive roller at the surface of the receiving slot, and means for driving said upper roller at the same rotational speed of said drive roller.

21. The apparatus according to claim 20 further comprising:

nipper means positioned below said cutter means for engaging the strip material therebetween, and means for operating said nipper means to engage the strip material prior to severing the material in the predetermined lengths.

22. An apparatus for ganging and cutting a plurality of layers of strip material in predetermined lengths, comprising:

a frame, a drive roller supported by said frame and having an annular receiving slot substantially corresponding to the width of the layers of strip material for receiving the layers of material therein, a driven roller supported adjacent said drive roller and having an annular shoulder for engaging the bottom of the receiving slot of said drive roller to pinch the layers of strip material therebetween, means for driving said drive roller to draw the strips of material between said drive and driven rollers, cutter means supported by said frame below said drive and driven rollers for severing said layers of material in predetermined lengths, and finger guides supported on opposite sides of the strip material adjacent said drive and driven rollers to prevent the strip material adhering to said drive and driven rollers as the strip material passes therebetween.

23. The apparatus according to claim 22 wherein said finger guides include elongated members positioned adjacent the surface of said drive and driven rollers and extending from above to below said rollers.

24. The apparatus according to claim 20 further comprising:

rack means for supporting a plurality of rolls each with one of the layers of material thereon, and means for supporting said rack adjacent said drive roller for feeding said strip material from said rolls in a layered orientation to said drive and driven rollers, said support means positioned relative to said drive roller such that said strip material moves substantially along a straight line from the material rolls to said drive roller.

25. The apparatus according to claim 20 further comprising:

rack means for supporting a plurality of rolls each with one of the layers of material thereon, roller guide means for receiving the layers of material thereover in a stacked relationship, and second roller guide means for maintaining the alignment of the stacked layers of strip material, said second roller guide means being aligned between said rack means and said drive roller.

26. The apparatus according to claim 25 wherein said rack means includes:

a frame, a plate attached to said frame, and a plurality of rolls rotatively attached to said plate, said rolls each having one of the strips of material wound thereon.

27. The apparatus according to claim 25 wherein said second guide means includes a convex roller spaced from a concave roller with said rollers in contact with and on opposite sides of the layers of strip material as the layers move from said rack means to said drive roller.

28. The apparatus according to claim 20 further comprising:

rack means for supplying the layers of material therefrom, and a roller guide means aligned between said rack means and said guide plate means and including a convex roller spaced from a concave roller with said rollers in contact with and on opposite sides of the layers of material as the layers of material move from said rack means to said drive roller.

29. The apparatus according to claim 20 further comprising:

a tension means mounted remote from said drive roller for tensioning the strip material as it is drawn by said drive roller.

30. An apparatus for ganging and cutting a plurality of layers of strip material in predetermined lengths, comprising:

a frame, a drive roller supported by said frame and having an annular receiving slot substantially corresponding to the width of the layers of strip material for receiving the layers of material therein, a driven roller supported adjacent said drive roller and having an annular shoulder for engaging the bottom of the receiving slot of said drive roller to pinch the layers of strip material therebetween, means for driving said drive roller to draw the strips of material between said drive and driven rollers, cutter means supported by said frame below said drive and driven rollers for severing said layers of material in predetermined lengths, and a tension means mounted remote from said drive roller for tensioning the strip material as it is drawn by said drive roller wherein said tension means includes a frame, a cylinder mounted on said frame for receiving the strip material therearound, and a movable bar adjustable relative to said cylinder for engagement of the strip material between said bar and said cylinder to restrict movement of the strip material past said cylinder thereby tensioning the strip material as it is drawn by said drive roller.

31. An apparatus for ganging and cutting a plurality of layers of strip material in predetermined lengths, comprising:

a frame, a drive roller supported by said frame and having an annular receiving slot substantially corresponding to the width of thelayers of strip material for receiving the layers of material therein, a driven roller supported adjacent said drive roller and having an annular shoulder for engaging the bottom of the receiving slot of said drive roller to pinch the layers of strip material therebetween, means for driving said drive roller to draw the strips of material between said drive and driven rollers, cutter means supported by said frame below said drive and driven rollers for severing said layers of material in predetermined lengths, and a tension means mounted remote from said drive roller for tensioning the strip material as it is drawn by said drive roller wherein said tension means comprises a U-shaped frame having a base leg with two side legs extending therefrom, a cylinder supported between the side legs remote from the base leg for receiving the strip material therearound, a bar having guide structure on its ends for slidable engagement on said side legs, and screw means acting between the base leg of said U-shaped frame and said bar for selectively moving said bar against said cylinder to engage the strip material between said bar and said cylinder thereby applying tension to the strip material as it is drawn by said drive roller.

32. The apparatus according to claim 31 further comprising:

a resilient pad attached to said bar adjacent said cylinder such that the strip material is engaged between said pad and said cylinder as said bar is moved toward said cylinder.

* * * * *

UNITED STATES PATENT AND TRADEMARK OFFICE

CERTIFICATE OF CORRECTION

PATENT NO. : 4,218,945

DATED : August 26, 1980

INVENTOR(S) : Roger C. Sharlow

It is certified that error appears in the above-identified patent and that said Letters Patent are hereby corrected as shown below:

Column 1, line 66, change "the layers" to -- The layers --.
Column 6, line 20, change "similarly" to -- Similarly --.
Column 9, line 39, change "throughbut" to -- through but --.
Column 11, lines 21-22, change "counterclockiwse" to -- counterclockwise --;
line 27, change "is" to -- in --.
Column 13, line 16, change "roller" to -- rollers --;
line 21, change "to" to -- of --.
Column 19, line 7, change "thelayers" to -- the layers --.

Signed and Sealed this

*Thirtieth* Day of *December 1980*

[SEAL]

*Attest:*

SIDNEY A. DIAMOND

*Attesting Officer*

*Commissioner of Patents and Trademarks*